United States Patent [19]

Melnyk et al.

[11] Patent Number: 4,921,773

[45] Date of Patent: May 1, 1990

[54] PROCESS FOR PREPARING AN ELECTROPHOTOGRAPHIC IMAGING MEMBER

[75] Inventors: Andrew R. Melnyk, Rochester; Richard H. Nealey, Penfield; Paul J. Brach, Rochester; Leon A. Teuscher, Webster, all of N.Y.

[73] Assignee: Xerox Corporation, Stamford, Conn.

[21] Appl. No.: 292,032

[22] Filed: Dec. 30, 1988

[51] Int. Cl.[5] ..... G03G 5/087; G03G 5/06; G03G 5/05; G03G 5/14

[52] U.S. Cl. ..... 430/132; 430/134; 430/56; 430/58

[58] Field of Search ..... 430/56, 130, 132, 134

[56] References Cited

U.S. PATENT DOCUMENTS

| | | | |
|---|---|---|---|
| 3,391,022 | 7/1968 | Saito | 430/56 X |
| 4,150,987 | 4/1979 | Anderson et al. | 430/59 |
| 4,390,610 | 6/1983 | Bowden et al. | 430/58 |
| 4,391,888 | 7/1983 | Chang et al. | 430/57 |
| 4,472,491 | 9/1984 | Wiedemann | 430/58 |
| 4,496,642 | 1/1985 | Tam et al. | 430/132 X |

FOREIGN PATENT DOCUMENTS

| | | | |
|---|---|---|---|
| 57-144560 | 9/1982 | Japan . | |
| 58-83857A | 5/1983 | Japan . | |
| 61-179454 | 8/1986 | Japan | 430/56 |

*Primary Examiner*—Roland E. Martin
*Attorney, Agent, or Firm*—Peter H. Kondo

[57] ABSTRACT

A process for preparing an electrophotographic imaging member comprising a substrate having an electrically conductive surface, a charge generating layer and a charge transport layer contiguous to the charge generating layer, the process comprising preparing a dispersion of finely divided photoconductive particles in a liquid in which the particles are insoluble, the liquid comprising at least 0.25 percent by weight of an alcohol based on the total weight of the liquid, applying a thin coating of the dispersion on a substrate, evaporating substantially all of the liquid from the coating, and embedding the particles in a film forming polymer matrix to form the charge generating layer.

18 Claims, No Drawings

PROCESS FOR PREPARING AN ELECTROPHOTOGRAPHIC IMAGING MEMBER

BACKGROUND OF THE INVENTION

This invention relates to electrophotography and more particularly, to an improved method of preparing an electrophotographic imaging member.

Generally, electrophotographic imaging processes involve the formation and development of electrostatic latent images on the imaging surface of a photoconductive member. The photoconductive member is usually imaged by uniformly electrostatically charging the imaging surface in the dark and exposing the member to a pattern of activating electromagnetic radiation such as light, to selectively dissipate the charge in the illuminated areas of the member to form an electrostatic latent image on the imaging surface. The electrostatic latent image is then developed with a developer composition containing toner particles which are attracted to the photoconductive member in image configuration. The resulting toner image is often transferred to a suitable receiving member such as paper. The photoconductive members include single or multiple layered devices comprising homogeneous or heterogeneous inorganic or organic compositions and the like. One example of a single layer photoconductive member containing a heterogeneous composition is described in U.S. Pat. No. 3,121,006 wherein finely divided particles of a photoconductive inorganic compound is dispersed in an electrically insulating organic resin binder. The commercial embodiment usually comprises a paper backing containing a coating thereon of a binder layer comprising particles of zinc oxide uniformly dispersed therein. Useful binder materials disclosed therein include those which are incapable of transporting for any significant distance injected charge carriers generated by the photoconductive particles. Thus, the photoconductive particles must be in substantially contiguous particle to particle contact throughout the layer for the purpose of permitting charge dissipation required for cyclic operation. Generally, about 50 percent by volume of photoconductive particles is usually necessary in order to obtain sufficient photoconductive particle to particle contact for rapid discharge. Other known photoconductive compositions include amorphous selenium, halogen doped amorphous selenium, amorphous selenium alloys including selenium arsenic, selenium tellurium, selenium arsenic antimony, halogen doped selenium alloys, cadmium sulfide and the like. These inorganic photoconductive materials are usually deposited as a relatively homogeneous layer on suitable conductive substrates. Some of these inorganic layers tend to crystallize when exposed to certain vapors that may occasionally be found in the ambient atmosphere. Moreover, the surfaces of selenium type photoreceptors are highly susceptible to scratches which print out in final copies. Layered photoreceptors, whereby the photogeneration function and the charge transport function are performed by separate layers, are well known, as disclosed, for example in U.S. Pat. No. 3,041,166 to J. Bardeen. Recently, there has been disclosed layered photoresponsive devices comprising charge transport layers comprising photogenerating particles and charge transport layers deposited on conductive substrates as described, for example, in U.S. Pat. No. 4,265,990 and overcoated photoresponsive materials containing a hole injecting layer, a hole transport layer, a photogenerating layer and a top coating of an insulating organic resin, as described, for example, in U.S. Pat. No. 4,251,612. Examples of photogenerating layers disclosed in these patents include trigonal selenium and various phthalocyanines and hole transport layers containing certain diamines dispersed in inactive polymer resin materials. The disclosures of each of these patents, namely, U.S. Pat Nos. 4,265,990 and 4,251,612 are incorporated herein by reference in their entirety. Other representative patents containing layered photoresponsive devices include U.S. Pat. Nos. 3,041,116; 4,115,116; 4,047,949 and 4,081,274. These patents relate to systems that require negative charging for hole transporting layers when the photogenerating layer is beneath the transport layer. Photogenerating layers overlying hole transport layers require positive charging but must be less than about 2 micrometers for adequate sensitivity. While the above described electrophotographic imaging members may be suitable for their intended purposes, there continues to be a need for improved devices. Thus, in summary, layered photoreceptors, whereby the photogeneration function and the charge transport function are performed by separate layers, are well known and many such structures are used in commercial xerographic copiers and printers. These layers can be made from inorganic materials, for example, chalcogenides; organic materials, for example, polymers with electronically active additives, and combinations of organic and inorganic materials. The charge generator layer typically consists of a polymer binder to which is added an organic or inorganic photoactive pigment. For lower loadings of pigment particles in a charge generating binder layer, the coatings were necessarily thick in order to secure sufficient optical absorption during imagewise exposure. Unfortunately, with thicker charge generation layers, light absorption by separate photogenerating pigment particles resulted in space charge build up and high internal fields that eventually led to dark decay and instability with electrical charge-erase cycling. In the rare case where the binder of the charge generating particles is ambipolar, a photoreceptor that was charged negatively would permit negative charges forming on the particles to travel to the conductive ground plane thereby avoiding space charge build up. However, for most film forming binders, the concentration of photoconductive pigment particles should be sufficiently high to afford particle-to-particle contact so that the negative charges are provided with paths to travel to the ground plane. The layers should also be thin to minimize the distance the positive and negative charge must travel in the generator layer. Unfortunately, high concentrations of pigment particles in a binder matrix is difficult to achieve. A common technique for preparing charge generation layers is to first place particles in a solution containing dissolved film forming binder material. Generally, with these mixtures, it is difficult to obtain charge generating binder layers containing high levels of loadings of pigment particles in the 70 percent to 80 percent by volume range. The coating of the charge generation pigment in a binder also present other problems. These include incompatibility of the charge generation transport layer polymer binders and/or solvents with the charge transport layer polymer binders and/or solvents. Also, it is difficult to form uniform, submicron, generator layers having high concentration of pigment particles from mixtures of charge generation pigment in a binder dissolved in a solvent. Moreover, swelling of the bottom layer can occur when coated with a second layer. Photogenerating layers have also been prepared by dissolving squarylium compounds in a solvent and thereafter applying the resulting solution to a substrate. This approach limits the range of materials that may be utilized in the photogenerating layer. Moreover, the deposited coating often does not adhere well to the underlying substrate and/or to subsequently applied layers. Some organic charge generating materials such as phthalocyanines are coated by vacuum deposition. Vacuum deposition, however, requires expensive and complex equipment and may result in poor adhesion between the evaporated layer and the solvent coated layer.

INFORMATION DISCLOSURE STATEMENT

U.S Pat. No. 4,391,888 issued to M. S. H. Chang et al on July 5, 1983—Organic photoconductive elements are disclosed having a charge generating layer and a charge transport layer carried on an electroconductive support. The invention involves a first layer between the support and the charge generating layer which is capable of functioning as (i) an adhesive bonding layer on the electroconductive support to provide a receptive and retentive base layer for the charge generating layer and (ii) as a barrier layer to prevent substantially any leakage of charge from the surface of the photoconductor, characterized by the first layer comprising at least one polycarbonate in combination with a charge generating layer that comprises at least one organic pigment. The charge generating layer pigment is dispersed in solvent and coated onto a substrate. A charge transport layer dissolved in a resinous binder is then applied to the charge-generating layer, e.g. see column 7, lines 1–68 column 8, lines 1–62. In column 8, lines 4–16, a dispersion of two squarylium compounds in a solvent system of tetrahydrofuran was ball milled from 8 hours to form a dispersion of solids in the solvent.

U.S. Pat. No. 4,150,987 issued to Anderson et al on Apr. 24, 1979—An electrophotgraphic imaging member is disclosed comprising a charge generation layer and a p-type hydrazone charge generation layer. Various charge generation materials are disclosed, for example, in column 4, line 39 to column 5, line 23. In column 9, lines 14–25 discloses that a charge generation layer is prepared by dissolving Chlorodaine Blue in a mixture of ethylenediamine, n-butylamine and tetrahydrofuran, the resulting solution miniscus coated on a polyester coated substrate, and the resulting coating dried in a forced air oven. A charge generation coating mixture of hydroxy squarylium in a solvent mixture of ethylenediamine, propylamine and tetrahydrofuran is described in Example 13 and a solution of hydroxy squarylium and methyl squarylium are described in Example 16. A charge generating layer of vacuum deposited selenium and tellurium is described in Example 17.

U.S. Pat. No. 4,472,491 issued to W. Wiedemann on Sept. 18, 1984—An electrophotographic recording material is disclosed comprising an electrically conductive support, an optional insulating interlayer, a photoconductive system comprised of at least one layer of organic material containing a charge carrier-producing compound and a charge-transporting compound, and a radiation-cured, transparent protective layer, wherein the protective layer has been applied onto the surface of the photoconductive system with the aid of a removable auxiliary support and is comprised of an acrylated binder which is cured by irradiation with ultraviolet light. Also disclosed is a process for the production of the recording material. The protective overcoat which also acts as a binder. An overcoat 3 is placed atop a photoconductive layer 2. The photoconductive layer is preferably a double layer comprising charge-carrier producing and charge-transporting compounds. (See column 5, lines 56–65; see FIG. 3).

U.S. Pat. No. 4,390,610 issued to Bowden et al on June 28, 1983—various photoreceptors are disclosed including those in which an adhesive layer is coated with a generating material such as a squarylium or tetramethylbenzidene, then with a hydroxy squarylium compound and finally with a charge transport material. In column 3, lines 1–15, a charge generating layer solution of a hydroxy squarylium compound dissolved in ethylenediamine and tetrahydrofuran is disclosed.

Japanese Pat. No. 57-1444560 issued to Canon Sept. 2, 1982—An electrophotographic receptor is disclosed comprising a carrier generation layer (CGL) of high sensitivity and a carrier transport layer (CTL) by containing a solvent which dissolves organic pigments acting as electric charge generating agents in a dispersion of the pigments. The pigment of a charge generating layer 2 is dissolved by treatment with an organic solvent. The charge transfer layer 3 containing a binder is then formed on the charge generating layer 2.

Japanese Pat. No. 58-83857 issued to Fuji Xerox on May 19, 1983—A photoreceptor is disclosed that exhibits no rising in residual potential, a little in background stain, is capable of forming a high resolution image, and has long life, because it uses a layer containing a charge transfer complex as a protective layer formed on a photosensitive layer located on a substrate.

While some of the above-described imaging members exhibit certain desirable properties such as protecting the surface of an underlying photoconductive layer, there continues to be a need for improved overcoating layers for protecting photographic imaging members.

SUMMARY OF THE INVENTION

It is, therefore, an object of the present invention to provide an improved process for fabricating an electrophotographic recording member which overcomes the above noted deficiencies.

It is another object of the invention is to provide an electrophotographic imaging member fabrication process which forms thin generation layers.

It is still another object of the invention is provide an electrophotographic imaging member fabrication process which forms charge generation layers having a high concentration of photoconductive pigment particles.

It is still another object of the invention is provide an electrophotographic imaging member fabrication process which forms charge generation layers that adhere well to an underlying surface.

It is still another object of the invention is provide an electrophotographic imaging member fabrication process which forms charge generation layers that adhere well to an overlying surface.

It is still another object of this invention is to provide an electrophotographic imaging member fabrication process which forms a charge generation layer having a uniform thickness.

SUMMARY OF THE INVENTION

In accordance with the present invention, there is provided a process for preparing an electrophotographic imaging member comprising a substrate having an electrically conductive surface, a charge generating layer and a charge transport layer contiguous to the charge generating layer, the process comprising preparing a dispersion of finely divided photoconductive particles in a liquid in which the particles are insoluble, the liquid comprising at least 0.25 percent by weight of an alcohol based on the total weight of the liquid, applying a thin coating of the dispersion on a substrate, evaporating substantially all of the liquid from the coating, and embedding the particles in a film forming polymer matrix to form the charge generating layer.

Electrophotographic imaging members prepared by the process of this invention are multilayered members comprising a charge generating layer contiguous to a charge transport layer. These layers are normally secured to a supporting substrate having an electrically conductive surface. The relationship of the charge generating layer and contiguous charge transport layer to the conductive surface may be varied. For example, the charge generating layer may be between the electrically conductive surface and the charge transport layer or the charge transport layer may be between the electrically conductive surface and the charge generating layer. If desired, other layers such as adhesive layers and/or charge blocking layers may be applied to the electrically conductive surface prior to the application of a charge generating layer. Also, if desired, protective overcoating layers may be applied to the top most layer.

The substrate may be opaque or substantially transparent and may comprise numerous suitable materials having the required mechanical properties. Accordingly, this substrate may comprise a layer of a non-conductive or conductive material such as an inorganic or an organic composition. If the substrate comprises non-conductive material, it is usually coated with a conductive composition. As insulating non-conducting materials there may be employed various resins known for this purpose including polyesters, polycarbonates, polyamides, polyurethanes, and the like. The insulating or conductive substrate may be flexible or rigid and may have any number of many different configurations such as, for example, a plate, a cylindrical drum, a scroll, and endless flexible belt, and the like. Preferably, the insulating substrate is in the form of an endless flexible belt and is comprised of a commercially available, biaxially oriented polyethylene terephthalate polyester known, for example, as Mylar available from E. I. du Pont de Nemours & Co. The thickness of the substrate layer depends on numerous factor, including economical considerations, and thus, this layer may be of substantial thickness, for example, over 200 microns, or of minimum thickness more than 50 microns, provided there are no adverse affects on the final photoconductive device. In one embodiment, the thickness of this layer ranges from about 65 micrometers to about 150 micrometers, and preferably from about 75 micrometers to about 125 micrometers. A conductive layer or ground plane which may comprise the entire support or be present as a coating on a non-conductive support and may comprise any suitable material including, for example, aluminum, titanium, nickel, chromium, brass, gold, stainless steel, carbon black, graphite and the like. The conductive layer may vary in thickness over substantially wide ranges depending on the desired use of the electrophotoconductive member, for example, semi-transparency may require a very thin conductive layer. Accordingly, the conductive layer can generally range in thickness of from about 5 nanometers to many millimeters. When a flexible photoresponsive imaging device is desired, the thickness may be between about 10 nanometers to about 100 nanometers, and more preferably from about 10 nanometers to about 20 nanometers.

If desired, any suitable charge blocking layer may be interposed between the conductive surface and subsequently applied layers. Some materials can form a layer which functions as both an adhesive layer and charge blocking layer. Any suitable blocking layer material capable of preventing charge carrier injection from the conductive layer may be utilized. Typical blocking layers include metal oxides polyvinylbutyral, organosilanes, epoxy resins, polyesters, polyamides, polyurethanes, silicones and the like. The silane reaction product described in U.S. Pat. No. 4,464,450 is particularly preferred as a blocking layer material because cyclic stability of the electrophotographic imaging layer is extended. The entire disclosure in U.S. Pat. No. 4,464,450 is incorporated herein by reference.

An optional adhesive layer may also be utilized in the electrophotographic imaging member fabricating process of this invention. The polyvinylbutyral, epoxy resins, polyesters, polyamides, and polyurethanes described above with reference to blocking layers can also serve as an adhesive layer. Adhesive and charge blocking layers preferably have a dry thickness between about 2 nanometers and about 200 nanometers. If desired, the blocking layer may comprise a softenable film forming polymer that is softenable by a solvent component of the fugitive liquid used to form the dispersion of finely divided photoconductive particles. The solvent component softens the softenable film forming polymer of the adhesive layer during application of the dispersion and facilitates penetration of the particles into the adhesive layer whereby the film forming polymer forms a polymer matrix around at least a portion of the deposited particles.

Any suitable photoconductive particles may be employed in the dispersion coating process of this invention. The photoconductive particles may be inorganic or organic. Typical inorganic photoconductive materials include well known materials such as amorphous and crystalline selenium, selenium alloys,-such as selenium-tellurium, selenium-tellurium-arsenic, selenium-arsenic, halogen-doped selenium alloys, and the like, cadmium sulfoselenide, cadmium selenide, cadmium sulfide, zinc oxide, titanium dioxide and the like. Typical organic photoconductors include various phthalocyanine pigments such as the X-form of metal free phthalocyanine described in U.S. Pat. No. 3,357,989, metal phthalocyanines such as zinc phthalocyanine, magnesium phthalocyanine, and copper phthalocyanine, metal oxide and halide phthalocyanines such as vanadyl phthalocyanine, titanyl phthalocyanine, chloroindium phthalocyanine, and the like, perylene dicarboximide derivatives, perinone dicarboximide derivatives, anthracene, quinacridones available from DuPont under the tradename Monastral Red, Monastral violet and Monastral Red Y, substituted 2,4-diamino-triazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange and the like. The photoconductive particles selected should be substantially insoluble in the liquids present in the liquid dispersion medium. The expression "substantially insoluble" as employed herein is defined as separation by filtration or centrifuge will recover nearly all the pigment and the mother liquid will be clear of pigment color, that is colorless if the solvent originally was colorless.

The photoconductive pigment particles may be formed by any suitable conventional technique. Typical particle preparation techniques include ball milling, attriting, homogenization, paint shaking, high shear mixing, colloidal ultrasonic dispersion, chemical colloidal preparation, and the like. Milling may be effected with dry particles, but milling in the presence of a liquid is preferred, particularly the suspension medium liquid because dispersion of the milled particles in the suspension medium liquid is enhanced. Generally, the average particles size of the photoconductive pigment particles should be less than about 1 micrometer. As average particle size increases beyond about 1 micrometer, the coating suspension life is shorter. Preferably, the photoconductive pigment particle size should be less than about 0.1 micrometer. Optimum dispersions and charge generation layers are obtain with average photoconductive particle pigment sizes of less than about 20 nanometers.

The photoconductive particles are dispersed in a fugitive liquid dispersion medium in which the photoconductive particles are substantially insoluble. Generally, when attempts are made to suspend photographic pigments particles in a liquid non-solvent free of alcohol, the suspension tends to settle out prior to application or during application as a coating. Settling of the pigment particles during application adversely affects the uniformity of the thickness of the deposited layer because the concentration of the coating mixture changes as it is being applied. These differences in thickness of the photogenerating layer impart non-uniform electrical properties to the layer. Surprisingly, when the liquid dispersion medium contains at least about 0.25 percent by weight alcohol, based on the total weight of the dispersion medium, for forming a thin uniform coating on a substrate and to achieve dispersion stability at least during the period during which the dispersed photoconductive particles are deposited to form a coating. Any suitable alcohol may be utilized in the suspension medium of this invention. A preferred alcohol may be represented by the general formula $C_nH_{2n-1}OH$ where n is a number from 1 to 6. Typical alcohols represented by the foregoing formula include methyl alcohol, ethyl alcohol, isopropyl alcohol, butyl alcohol and the like and mixtures thereof. Other alcohols include dihydric and trihydric alcohols such as glycol and glycerol. Generally, to facilitate removal of substantially all of the alcohol from the deposited charge transport layer under practical conditions, the dispersion medium components including the alcohol should have a boiling point between about 40° C. and about 140° C. For sufficiently stable dispersions, the liquid dispersion medium should contain at least about 0.25 percent by weight, based on the total weight of the liquid dispersion medium, of alcohol. If desired, the dispersion medium may contain as much as 100 percent alcohol. The preferred range is between about 2 percent and about 10 percent by weight alcohol, based on the total weight of the liquid dispersion medium.

The liquid dispersion medium should be substantially free of any film forming polymer. The presence of a film forming polymer can promote agglomeration of the photoconductive particles in the dispersion and adversely affects the achievement of dense, uniform, submicron coatings of photoconductive particles to form the charge generation layer. Moreover, the presence of alcohol in the liquid dispersion medium can adversely interact with some film forming polymers. For example, a generator layer coating mixture containing alcohol and a polycarbonate resin binder results in the crystallization of the polycarbonate resin. However, crystallization may be avoided by forming a matrix of polycarbonate around the photoconductive particles after the alcohol is removed by evaporation from the thin layer of deposited particles.

In addition to the essential part of the alcohol component, the fugitive liquid dispersion medium may contain other non-alcoholic liquids which are miscible with alcohol. Typical liquids which are miscible with alcohol include methylene chloride, trichloroethane, tetrahydrofuran, dichloroethane, chlorobenzene, toluene and the like and mixture thereof. These non-alcoholic liquids preferably have a boiling point between about 40° C. and about 140° C. to facilitate rapid removal after deposition of the dispersion. If desired, a mixture of liquids having different boiling points may be employed in the dispersion liquid to control evaporation rate.

The concentration of photoconductive pigment particles in the dispersion should be between about 0.1 percent by weight and about 10 percent by weight, based on the total weight of the dispersion. The specific concentration depends, to some extent, upon the technique utilized for applying the dispersion to a substrate. For example, the solids concentration of between about 0.2 percent by weight to about 2 percent by weight, based on the total weight of the dispersion, is desirable for spray coating applications. Relatively low solid concentrations are desired in order to achieve the uniform layers required for adequate charge generation characteristics. The particle of the pigment particles will, of course, also affect the stability of the dispersion. Thus, smaller particles will form more stable dispersions than larger particles.

If desirable, any suitable additive may be utilized in the dispersion mixture. For example, a small molecule charge transport layer material may be dissolved in the liquid dispersion medium to enhance the electrical properties of the final charge generation layer. Typical charge transport molecules described in detail below with reference to the charge transport layer. Other well known coating mixture additives include, for example, wetting agents, surfactants, and the like. Generally, any additives employed should not adversely affect the stability of the liquid dispersion or the electrical properties of the final generator layer.

Any suitable technique may be utilized to apply the liquid dispersion of photoconductive pigment particles to a substrate. Typical coating techniques include spray coating, dip coating, extrusion coating, meniscus coating, gravure coating, wire wound rod coating, and the like.

Any suitable drying technique may be employed to dry the deposited dispersion coating. Typical drying techniques include forced air oven drying, infra-red lamp drying, air-impingement drying, vacuum oven drying, microwave oven drying and the like. Drying should be sufficient to removal substantially all of the liquid dispersion medium. Thus, the expression substantially all of the liquid medium is intended to mean that at least about 98 percent by weight of the dispersion medium, based on the total weight of the deposited solids, is removed during drying. Satisfactory results are achieved when the thickness of the charge generation particle layer after drying is between about 0.01 micrometer and 1 micrometer. Thicknesses greater than about 1 micrometer provide no further advantages and render imbedding of the deposited pigment particles in a film forming matrix more difficult. Generally, charge generation particle layer thicknesses between 0.1 and 0.3 are preferred. Thicknesses less than about 0.1 micrometer are probably desirable if particles having an average particle size of less than about 0.01 micrometers and high absorption are available in practical quantities.

The deposited photoconductive particles may be embedded in a film forming polymer matrix by any suitable technique. For example, if the charge generation particle layer is deposited on a surface comprising a softenable film forming polymer material, the particles may be embedded in the softenable film forming polymer during and/or subsequent to deposition. The softenable film forming polymer may be softened by any suitable technique. For example, softening may be effected by the use of a solvent in the dispersion medium which softens or dissolves the softenable film forming polymer. If desired, softening of the softenable film forming polymer may be achieved by exposing the softenable film forming polymer to solvent vapors during and/or after deposition of the pigment particles. Alternatively, softening may be effected by applying heat to the softenable film forming polymer during or subsequent to deposition of the photoconductive particles. If heat softening is utilized to soften the softenable film forming polymer, sufficient heat should be applied to exceed the glass transition temperature of the polymer allowing the pigment particles to sink into the polymer. Combinations of two or more of the foregoing softening techniques may also be utilized to embed the pigment particles in the softenable film forming polymer matrix. With dispersion deposition techniques involving rapid evaporation of the liquid dispersion medium during deposition, e.g., spray coating, embedding may begin while the particles are being deposited.

Alternatively, the deposited particles on an underlying member need not be imbedded in a matrix of material supplied by the underlying member. Instead, the deposited particles may be dried to form a powder which is imbedded in a matrix of film forming polymer provided by a subsequently applied layer. Moreover combinations of the foregoing techniques may be utilized wherein at least some of the particles are partially imbedded into polymer material in both underlying layers and overlying layers.

The dispersion of photogenerating particles may be applied to various types of layers. Where the layer comprises a film forming polymer, the layer may be a conductive layer, a blocking layer, an adhesive layer, or a charge transport layer. Where the film forming polymer matrix is provided by a layer applied after the photogenerating particles are applied, the underlying layer need not contain any film forming polymer. Layers that are applied subsequent to application of the photogenerating particles may be selected from layers such as transport layers or overcoating layers. If no overcoating is to be employed, embedding of the particles in an underlying polymer matrix should be sufficient to prevent rubbing away of the particles during subsequent electrophotographic imaging processing steps.

Thus, numerous embodiments of this invention are contemplated. For example, the deposited charge generation layer may be sandwiched between:

(a) a charge transport layer and an electrically conductive surface;

(b) a charge transport layer and an adhesive layer;

(c) a charge transport layer and a blocking layer; and (d) a charge transport layer and an overcoating layer.

Thus, the film forming polymer matrix in which the photoconductive particles are embedded may be at least partially provided by an electrically conductive layer charge blocking layer, an adhesive layer, or in a charge transport layer. Generally, it is preferred that the charge generation layer particles are embedded in one surface of a charge transport layer, because the charge transport layer polymer normally contains a small molecular transport material thereby providing an active matrix for the photoconductive material.

To further illustrate a specific embodiment, a thin layer of the pigment particles is coated directly on an adhesive interface layer, dried and coated with a transport layer coating solution comprising electron donor molecules, a thermoplastic film forming polymeric binder, and a solvent for the polymer. Some of the binder from the transport layer coating solution, doped with the electron donor molecules, penetrates and becomes the matrix binder of the generation layer, providing both cohesive strength to the generation layer particles and adhesion to the underlying material or layer. In another embodiment, a charge transport layer comprising electron donor molecules, a thermoplastic film forming polymeric binder is overcoated with a layer of a liquid dispersion of photogenerating pigment particles dispersed in a liquid comprising alcohol and a solvent that dissolves the transport layer binder. The solvent from the dispersion softens the polymeric binder and the pigment penetrates into and is imbedded in the softened binder. Thus, by selection of suitable solvents for the pigment dispersion and adjustment of any applied heat, the degree of penetration and binding of the generation layer into an underlying softenable polymer containing layer can be readily controlled. Alternatively, by using a solvent that does not soften the transport layer, for example, an alcohol on a polycarbonate transport layer, a dry powder layer of photogenerating pigment particles is formed on the transport layer. The dry powder layer of photogenerating pigment particles is overcoated with an overcoating layer solution comprising a thermoplastic film forming polymeric binder and a solvent for the polymer. At least some of the polymeric binder forms a matrix around the photogenerating pigment particles to form a charge generation layer having a sharply defined boundary with the charge transport layer.

Any suitable charge transport material may be utilized in the process of this invention for preparing the electrophotographic imaging member. The charge transport layer should be capable of supporting the injection of photo-generated holes and electrons from the charge transport layer and allowing the transport of these holes or electrons through the charge transport layer to selectively discharge the surface charge. The active charge transport layer not only serves to transport holes or electrons, but can also protects the photoconductive layer from abrasion of chemical attack and therefor extends the operating life of the photoreceptor imaging member. Thus, the charge transport layer is a substantially non-photoconductive material which supports the injection of photogenerated holes from the generation layer. If the transport layer overlies the generator layer, the transport layer is normally transparent when exposure is effected through the transport layer to ensure that most of the incident radiation is utilized by the underlying charge carrier generator layer for efficient photogeneration. If the transport layer overlies the generator layer and is used with a transparent substrate, imagewise exposure may be accomplished through the substrate with all light passing through the substrate. In this case, the active transport material need not be absorbing in the wavelength region of use. The charge transport layer in conjunction with the generation layer in the instant invention is a material which is an insulator to the extent that an electrostatic charge placed on the transport layer is not conductive in the absence of illumination, i.e. a rate sufficient to prevent the formation and retention of an electrostatic latent image thereon when the transport layer overlies the generator layer.

The charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer.

Any suitable charge transport compound capable of acting as a film forming binder or which is soluble or dispersible on a molecular scale in a film forming binder may be utilized in the continuous phase of the charge transport layer. The charge transport compound should be capable of transporting charge carriers injected by the charge injection enabling particles in an applied electric field. The charge transport compounds may be hole transport molecules or electron transport molecules. Where the charge transport molecule itself is capable of acting as a film forming layer, it may if desired, be employed to function as the continuous charge transporting phase without the necessity of incorporating a different charge transport molecule in solid solution or as a molecular dispersion therein. Charge transporting materials are well known in the art. In addition to the film forming polymers having charge transport capabilities, a partial listing representative of non-film forming charge transporting materials include the following:

Diamine transport molecules of the types described in U.S. Pat. Nos. 4,306,008, 4,304,829, 4,233,384, 4,115,116, 4,299,897, 4,265,990 and 4,081,274. Typical diamine transport molecules include N,N'-diphenyl-N,N'-bis(allkylphenyl)-[1,1'-biphenyl]-4,4'-diamine wherein the alkyl is, for example, methyl, ethyl, propyl, n-butyl, etc. such as N,N'-diphenyl-N,N'-bis(3''-methylphenyl)-[1,1'-biphenyl]-4,4'-diamine, N,N'-diphenyl-N,N'-bis(4-methylphenyl)-[1,1'-biphenyl]-4,4'-diamine, May 7, 1985 Mammino, et. al. N,N'-diphenyl-N,N'-bis(2-methylphenyl)-[1,1'-biphenyl]-4,4'-diamine, N,N'-diphenyl-N,N'-bis(3-ethylphenyl)-[1,1'-biphenyl]-4,4'-diamine, N,N'-diphenyl-N,N'-bis(4-ethylphenyl)-[1,1'-biphenyl]-4,4'-diamine, N,N'-diphenyl-N,N'-bis(4-n-butylphenyl)-[1,1'-biphenyl]-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3methylphenyl)-pyrenyl-1,6-diamine, and the like. Pyrazoline transport molecules as disclosed in U.S. Pat. Nos. 4,315,982, 4,278,746, and 3,837,851. Typical pyrazoline transport molecules include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, May 7, 1985 Mammino, et. al. 1-[pyridyl-(2)]-3-(p-diethylaminostyryl)-5-(p-diethylaminophenyl)pyrazoline, 1-[6-methoxypyridyl-(2)]-3-(p-diethylaminostyryl)- 5-(p-diethylaminophenyl) pyrazoline, 1-phenyl-3-[p-dimethylaminostyryl]-5-(p-dimethylaminostyryl)pyrazoline, 1-phenyl-3-[p-diethylaminostryryl]-5-(p-diethylaminostyryl)pyrazoline, and the like. Substituted fluorene charge transport molecules as described in U.S. Pat. No. 4,245,021. Typical fluorene charge transport molecules include 9-(4'-dimethylaminobenzylidene)fluorene, 9-(4'-methoxybenzylidene)fluorene, 9-(2,4'-dimethoxybenzylidene)fluorene, 2-nitro-9-benzylidene-fluorene, 2-nitro-9-(4'-diethylaminobenzylidene)fluorene and the like. Oxadiazole transport molecules such as 2,5-bis(4-diethylaminophenyl)-1,3,4-oxadiazole, pyrazoline, imidazole, triazole, and others described in German Pat Nos. 1,058,836, 1,060,260 and 1,120,875 and U.S. Pat. No. 3,895,944. Hydrazone transport molecules including p-diethylaminobenzaldehyde-(diphenylhydrazone), o-ethoxy-p-diethylaminobenzaldehydr-(diphenylhydrazone), o-methyl-p-diethylaminobenzaldehyde-(diphenylhydrazone), o-methyl-p-dimethylaminobenzaldehyde(diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), p-dimethylaminobenzaldehyde-(diphenylhydrazone) and the like described, for example in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and other hydrazone transport molecules described, for example in U.S. Pat Nos. 4,385,106, 4,338,388, 4,387,147, 4,399,208 and 4,399,207. Another charge transport molecule is a carbazole phenyl hydrazone such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and other suitable carbazole phenyl hydrazone transport molecules described, for example, in U.S. Pat. No. 4,256,821. Similar hydrazone transport molecules are described, for example, in U.S. Pat. No. 4,297,426. Tri-substituted methanes such as alkyl-bis(N,N-dialkylaminoaryl)methane, cycloalkyl-bis(N,N-dialkylaminoaryl)methane, and cycloalkenyl-bis(N,N-dialkylaminoaryl)methane as described, for example, in U.S. Pat. No. 3,820,989. 9-fluorenylidene methane derivatives including (4-n-butoxycarbonyl-9-fluorenylidene)malonontrile, (4-phenethoxycarbonyl-9-fluorenylidene)malonontrile, (4-carbitoxy-9-fluorenylidene)malonontrile, (4-n-butoxycarbonyl-2,7-dinitro-9-fluorenylidene)malonate, and the like. Other typical transport materials include the numerous transparent organic non-polymeric transport materials described in U.S. Pat. No. 3,870,516 and the nonionic compounds described in U.S. Pat. No. 4,346,157. The disclosures of each of the patents identified above pertaining to charge transport molecule which are soluble or dispersible on a molecular scale in a film forming binder are incorporated herein in their entirety. Other transport material such as poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric or non-polymeric transport materials as described in U.S. Pat No. 3,870,516. When the charge transport molecules are combined with an insulating film forming binder, the amount of charge transport molecule which is used may vary depending upon the particular charge transport material and its compatibility (e.g. solubility in the continuous insulating film forming binder phase of the overcoating layer) and the like. Proportions normally used to form the charge transport medium of photoreceptors containing a charge transport component and a charge generating component are described in the partial listing above.

Any suitable insulating film forming binder having a very high dielectric strength and good electrically insulating properties may be used in the continuous charge transporting phase of the overcoating of this invention. The binder itself may be a charge transporting material or one capable of holding transport molecules in solid solution or as a molecular dispersion. A solid solution is defined as a composition in which at least one component is dissolved in another component and which exists as a homogeneous solid phase. A molecular dispersion is defined as a composition in which particles of at least one component are dispersed in another component, the dispersion of the particles being on a molecular scale. Typical film forming binder materials that are not charge transporting material include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amide-imide), styrene-butadiene copolymers, vinylidenechloride-vinylchloride copolymers, vinylacetate-vinylidenechloride copolymers, styrene-allkyd resins, and the like. Any suitable film forming polymer having charge transport capabilities may be used as a charge transport layer material. Polymers having charge transport capabilities are substantially nonabsorbing in the spectral region of intended use, but are "active" in that they are capable of transporting charge carriers injected by the charge injection enabling particles in an applied electric field. The charge transport polymer may be a hole transport film forming polymer or an electron transport film forming polymer. Charge transporting film forming polymers are well known in the art. A partial listing representative os such charge transporting film forming polymers includes the following:

Polymeric binders polymers prepared from diphenyl diamines, triphenyl methane polyamines and the like. Polyvinylcarbazole and derivatives of Lewis acids described in U.S. Pat. No. 4,302,521. Vinyl-aromatic polymers such as polyvinyl anthracene, polyacenaphthylene; formaldehyde condensation products with various aromatics such as condensates of formaldehyde and 3-bromopyrene; 2,4,7-trinitrofluoreoene, and 3,6-dinitro-N-t-butylnaphthalimide as described in U.S. Pat. No. 3,972,717. Other transport materials such as poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric transport materials as described in U.S. Pat. No. 3,870,516. The disclosures of each of the patents identified above pertaining to binders having charge transport capabilities are incorporated herein in their entirety.

Preferred charge transport layers comprise an electrically inactive resin material, e.g. a polycarbonate made electrically active by the addition of one or more of the following compounds poly-N-vinylcarbazole; poly-1-vinylpyrene; poly-9-vinylanthracene; polyacenaphthalene; poly-9-(4-pentenyl)-carbazole; poly-9-(5-hexyl)-carbazole; polymethylene pyrene; poly-1-(pyrenyl)-butadiene; N-substituted polymeric acrylic acid amides of pyrene; N,N'-diphenyl-N,N'-bis(phenylmethyl-[1,1'-biphenyl]-4,4'-diamine; N,N'-diphenyl-N,N'-bis(3-methylphenyl)-2,2'-dimethyl-1,1'-biphenyl-4,4'-diamine and the like.

An especially preferred transport layer employed in one of the two electrically operative layers in the multilayer photoconductor of this invention comprises from about 25 to about 75 percent by weight of at least one charge transporting aromatic amine compound, and about 75 to about 25 percent by weight of a polymeric film forming resin in which the aromatic amine is soluble.

Excellent results in controlling dark decay and background voltage effects have been achieved when the imaging members doped in accordance with this invention comprising the dispersion deposited a charge generation layer and a contiguous charge transport layer of a polycarbonate resin material having a molecular weight of from about 20,000 to about 120,000 having dispersed therein from about 25 to about 75 percent by weight of one or more compounds having the general formula:

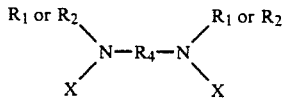

wherein wherein $R_1$, and $R_2$ are an aromatic group selected from the group consisting of a substituted or unsubstituted phenyl group, naphthyl group, and polyphenyl group and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms and X is an aryl group substituted with a group selected from the group consisting of an alkyl group having from 1 to about 4 carbon atoms and chlorine, the photoconductive layer exhibiting the capability of photogeneration of holes and injection of the holes and the charge transport layer being substantially non-absorbing in the spectral region at which the photoconductive layer generates and injects photogenerated holes but being capable of supporting the injection of photogenerated holes from the photoconductive layer and transporting said holes through the charge transport layer. The substituents should be free form electron withdrawing groups such as $NO_2$ groups, CN groups, and the like.

Specific examples of charge transporting aromatic amines for charge transport layers capable of supporting the injection of photogenerated holes of a charge generating layer and transporting the holes through the charge transport layer include triphenyl almine, tri-tolyl amine, triphenylmethane, bis(4-diethylamine-2-methylphenyl) phenylmethane; 4'-4''-bis(diethylamino)-2',2''-dimethyltriphenyl-methane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-(1,1'-biphenyl)-4,4'-diamine, and the like dispersed in an inactive resin binder.

The preferred electrically inactive resin materials are polycarbonate resins have a molecular weight from about 20,000 to about 100,000, more preferably from about 50,000 to about 100,000. The electrically inactive resin material may, for example, be selected from poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A. G. and a polycarbonate resin having a molecular weight of from about 20,000 to about 50,000 available as Merlon from Mobay Chemical Company.

In all of the above charge transport layers where an activating compound is dissolved or dispersed in an inactive polymeric material, the activating compound which renders the electrically inactive polymeric material electrically active should normally be present in amounts of from about 15 to about 75 percent by weight.

Any suitable and conventional technique may be utilized to mix and thereafter apply the charge transport layer coating mixture to the underlying layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used. In general, the ratio of the thickness of the charge transport layer to the charge generator layer is preferably maintained from about 2:1 to 200:1 and in some instances as great as 400:1.

Optionally, an overcoat layer may also be utilized to improve resistance to abrasion. These overcoating layers may comprise organic polymers or inorganic polymers that are electrically insulating or slightly semi-conductive.

A number of examples are set forth hereinbelow and, other than the control examples, are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE 1

Binderless Dispersion

A binderless dispersion of vanadyl phthalocyanine pigment was prepared by placing 1.4 grams of the pigment in a four ounce amber bottle. To this was added 26 grams of methylene chloride and two grams of n-butyl alcohol. About 200 grams of stainless steel shot was added to the bottle, the bottle was capped and the contents were mixed in a paint shaker for one and one-half hour. The dispersion was poured in 25 milliliter graduated cylinders and left on the bench. No change in the dispersion was noted after a day and after about two days a slight decrease in the density of the top portion was noted.

CONTROL EXAMPLE 2

Binderless Dispersion

A binderless dispersion of vanadyl phthalocyanine pigment was prepared as in example 1, but 28 grams of methylene chloride and no n-butyl alcohol was used. The dispersion was poured in 25 milliliter graduated cylinders and left on the bench. After about five hours the dispersion separated into a clear liquid on top and a colored dispersion on the bottom.

EXAMPLE 3

Binderless Dispersion

A binderless dispersion of vanadyl phthalocyanine pigment was prepared as in example 1, but 28 grams of n-butyl alcohol and no methylene chloride was used. The dispersion was poured in 25 milliliter graduated cylinders and left on the bench. After a week the dispersion showed no separation.

EXAMPLE 4

Binderless Dispersion

A binderless dispersion of vanadyl phthalocyanine pigment was prepared as in example 3, but instead of mixing in a paint shaker the dispersion was mixed in a ball mill for 5 days. The dispersion was poured in 25 milliliter graduated cylinders and left on the bench. After a week the dispersion showed no separation.

CONTROL EXAMPLE 5

Binderless Dispersion

A binderless dispersion of vanadyl phthalocyanine pigment was prepared as in example 4, but 28 grams of methylene chloride and no n-butyl alcohol was used. The dispersion was poured in 25 milliliter graduated cylinders and left on the bench. After about five hours the dispersion separated into a clear liquid on top and a colored dispersion on the bottom.

EXAMPLE 6

Binderless Dispersion

A binderless dispersion of vanadyl phthalocyanine pigment was prepared as in example 1, but 14 grams of isopropyl alcohol and 14 grams methylene chloride was used. The dispersion was poured in 25 milliliter graduated cylinders and left on the bench. After a week the dispersion showed no separation. A portion of this dispersion was then placed in a centrifuge and spun for 2 hours at 1200 RPM. The dispersion separated into a clear portion and a concentrated dispersion of the pigment. Shining light through the clear mother liquors showed no Tyndal Effect.

EXAMPLE 7

Binderless Dispersion

A binderless dispersion of bisbenzimidazole perylene 3,4,9,10 tetracarboxylic acid pigment was prepared as in Example 6. The dispersion was poured in 25 milliliter graduated cylinders and left on the bench. After a week the dispersion showed no separation. A portion of this dispersion was then placed in a centrifuge and spun for 2 hours at 1200 rpm. The dispersion separated into a clear portion and a concentrated dispersion of the pigment. Shining light through the clear mother liquors showed no Tyndal Effect.

EXAMPLE 8

A photoconductive imaging member was prepared by providing an aluminum cylinder 84 mm in diameter. The cylinder was degreased.

A charge transport layer solution was then prepared by dissolving 222 grams of polycarbonate resin (Merlon M39, available from Mobay Chemical Co.) in 2359.8 grams of methylene chloride and 1573.2 grams of 1,1,2-trichloroethane by placing the material in a plastic bottle and tumbling for one hour. The solution was allowed to stand one day for complete dissolution of the polymer. Then 120 grams of N,N'-diphenyl-N,N'-bis(3-methylphenyl)-1,1'-biphenyl-4,4'diamene was added and the mixture was tumbled for 2 hours. Just prior to coating the solution was let down by adding 2212.3 grams of methylene chloride and 1474.8 grams of 1,1,2-trichloroethane.

The solution was spray-coated unto the aluminum cylinder using a BINKS Model 21 automatic spray gun (available from Binks Company, Franklin Par, Ill.) with the cylinder mounted on a turntable rotated at 120 rpm. The material was sprayed on in three passes with the spray gun maintained 8 inches from the cylinder and traversing at a speed of 6.5 feet per minute. The coating was premitted to flash off for 5 minutes and the coated cylinder was then placed in an oven at 38° C. for 20 minutes. Next the coated cylinder was dried at 120° C. for one hour. This resulted in a dried charge transport layer 15 micrometers thick.

This coated member was overcoated with a charge generation layer by spray coating with a binderless charge generator dispersion. The dispersion was prepared by placing 25.9 grams of vanadyl phthalocyanine, 418.8 grams of methylene chloride and 3200 grams of $\frac{1}{8}$ inch stainless steel shot in a bottle. The mixture was capped and put in a paint shaker for one hour. After straining out the steel shot, the two percent solution was diluted to 0.5 percent by adding 4657.6 gram of methylene chloride and 77.7 grams of n-butanol, that is 1.5 percent alcohol. The dispersion was then tumbled for one hour and spray coated with two passes. After a 5 minute flash off, the resulting coating was dried at 40° C. for 15 minutes and at 110° C. for 60 minutes.

The resulting charge generation layer adhered to the charge transport layer very well. Rubbing the surface did not remove any pigment. A "Scotch" brand adhesive tape test was then employed. In this test, one end of the tape was applied to the charge generation layer the other end was thereafter pulled to remove the tape from the charge generation layer. This test could not delaminate the generation layer.

EXAMPLE 9

A photoconductive imaging member was prepared as in example 8 except that the charge generator dispersion contained 2.2 percent isopropyl alcohol and 0.25 percent solids. A three micrometer overcoat of 2 percent by weight arsenic and 98 percent by weight selenium alloy was vacuum deposited over the charge generation layer while the aluminum cylinder was maintained at 70° C. Transmission electron micrographs revealed that the resulting charge generation layer was 0.32 micrometers thick and intimately imbedded in the transport layer.

The resulting photosensitive member having two electrically operative layers was electrically evaluated in a continuously rotating scanner subjecting the photosensitive member to be charged positively and erased with an incandescent erase lamp every three seconds. The photosensitive member charged capacitively to 928 volts with 130 nanocoulombs of charge applied per square centimeter and exhibited a dark discharge of 40 volts per second, one second after charging. The photosensitive member required 12.5 ergs per square centimeter of 825 nanometer light to discharge from 850 volts to 150 volts. The residual voltage was approximately 20 volts. Continuous cycling for 1000 cycles resulted in no change in residual voltage and a 20 volt increase in dark potential voltage. The dark discharge and the sensitivity also did not change over the 1000 cycles.

Other modifications of the present invention will occur to those skilled in the art based upon a reading of the present disclosure. These are intended to be included within the scope of this invention.

What is claimed is:

1. A process for preparing an electrophotographic imaging member comprising a substrate having an electrically conductive surface, a charge generating layer and a charge transport layer contiguous to said charge generating layer, said process comprising preparing a dispersion of finely divided photoconductive particles in a fugitive liquid in which said particles are substantially insoluble, said liquid comprising at least 0.25 percent by weight of an alcohol, based on the total weight of said liquid, said dispersion being substantially free of any film forming polymer, applying a thin coating of said dispersion on a substrate, evaporating substantially all of said liquid from said coating, and embedding said particles in a film forming polymer matrix to form said charge generating layer.

2. A process for preparing an electrophotographic imaging member according to claim 1 wherein said finely divided photoconductive particles have an average particle size of less than about 1 micrometer.

3. A process for preparing an electrophotographic imaging member according to claim 1 wherein said finely divided photoconductive particles have an average particle size of less than about 0.1 micrometer.

4. A process for preparing an electrophotographic imaging member according to claim 1 wherein said alcohol is a compound represented by the general formula $C_nH_{2n-1}OH$ where n is a number from 1 to 6.

5. A process for preparing an electrophotographic imaging member according to claim 1 wherein said alcohol has a boiling point between about 40° C. and about 140° C.

6. A process for preparing an electrophotographic imaging member according to claim 1 wherein said dispersion has a solids concentration of between about 0.1 percent by weight to about 10 percent by weight, based on the total weight of said dispersion.

7. A process for preparing an electrophotographic imaging member according to claim 1 wherein said charge generating layer has a thickness of between about 0.01 micrometer and about 1 micrometer.

8. A process for preparing an electrophotographic imaging member according to claim 1 wherein said charge generating layer has a thickness of between about 0.1 micrometer and about 0.3 micrometer.

9. A process for preparing an electrophotographic imaging member according to claim 1 including applying an adhesive layer comprising a softenable film forming polymer to said electrically conductive surface, applying a layer of said dispersion to said adhesive layer, said fugitive liquid comprising a solvent for said softenable film forming polymer whereby said solvent softens said adhesive layer and said particles penetrate into said adhesive layer, drying said layer of said dispersion whereby said particles are imbedded in a matrix comprising said film forming polymer to form said charge generation layer overlying said adhesive layer, and applying said charge transport layer.

10. A process for preparing an electrophotographic imaging member according to claim 1 including applying a blocking layer to said electrically conductive surface, applying a layer of said dispersion to said adhesive layer, drying said layer of said dispersion to form a layer of said particles on said blocking layer, applying a solution of a charge transport molecule and a film forming polymer in a solvent to said layer of said particles, and drying said solution to form said charge transport layer whereby said particles are imbedded in a matrix comprising said charge transport molecule and said film forming polymer to form said charge generating layer underlying said charge transport layer.

11. A process for preparing an electrophotographic imaging member according to claim 1 including applying said charge transport layer to said electrically conductive surface, said charge transport layer comprising a softenable film forming polymer, applying a layer of said dispersion to said charge transport layer, said fugitive liquid comprising a solvent for said softenable film forming polymer whereby said solvent softens said charge transport layer and said particles penetrate into said charge transport layer, and drying said layer of said dispersion to form said charge generating layer.

12. A process for preparing an electrophotographic imaging member according to claim 1 including applying said charge transport layer to said electrically conductive surface, said charge transport layer comprising a softenable film forming polymer, applying a layer of said dispersion to said charge transport layer, drying said layer of said dispersion to form a layer of said particles on said charge transport layer, applying an overcoating layer mixture comprising a solution of a film forming polymer in a solvent to said layer of said particles, and drying said solution to form an overcoating layer whereby said particles are imbedded in a matrix comprising said film forming polymer to form said charge generating layer underlying said overcoating layer.

13. A process for preparing an electrophotographic imaging member according to claim 1 including applying said charge transport layer to said electrically conductive surface, said charge transport layer comprising a charge transport molecule and a softenable film forming polymer, applying a layer of said dispersion to said charge transport layer, heating said layer of said dispersion to remove said fugitive liquid, soften said film forming polymer and imbed said particles into the adjacent surface of said charge transport layer whereby said particles are imbedded in a matrix comprising said charge transport molecule and said film forming polymer to form said charge generating layer overlying said charge transport layer.

14. A process for preparing an electrophotographic imaging member according to claim 1 including applying said charge transport layer to said electrically conductive surface, said charge transport layer comprising a charge transport molecule and a polycarbonate resin, applying a layer of said dispersion to said charge transport layer, heating said layer of said dispersion to remove said fugitive liquid and form a layer of said particles, and softening said polycarbonate resin adjacent said coating of particles whereby said particles penetrate into the softened polycarbonate resin.

15. A process for preparing an electrophotographic imaging member according to claim 14 comprising including softening said polycarbonate binder by applying a halogenated solvent prior to applying a layer of said dispersion.

16. A process for preparing an electrophotographic imaging member according to claim 14 comprising including softening said polycarbonate binder by applying a halogenated solvent while applying a layer of said dispersion.

17. A process for preparing an electrophotographic imaging member according to claim 14 comprising including softening said polycarbonate binder by applying a halogenated solvent subsequent to applying a layer of said dispersion.

18. A process for preparing an electrophotographic imaging member according to claim 1 wherein said liquid comprises between about 2 percent by weight and about 10 percent by weight of said alcohol, based on the total weight of said liquid.

* * * * *